US005174768A

United States Patent [19]

Hewison et al.

[11] Patent Number: 5,174,768

[45] Date of Patent: Dec. 29, 1992

[54] SHIELD TERMINATOR

[76] Inventors: Charles M. Hewison, Box 313 Rd. 1, New Hartford, N.Y. 13413; Ross A. Hewison, 2036 Genesee St., Utica, N.Y. 13502

[21] Appl. No.: 843,153

[22] Filed: Feb. 28, 1992

[51] Int. Cl.[5] ..... H01R 13/648

[52] U.S. Cl. ..... 439/95; 439/98; 174/51

[58] Field of Search ..... 439/95, 98, 96, 610, 439/579, 497; 174/51

[56] References Cited

U.S. PATENT DOCUMENTS

| | | | |
|---|---|---|---|
| 2,092,930 | 9/1937 | Paradise | 439/607 |
| 3,513,433 | 5/1970 | Carroll | 439/579 |
| 3,990,765 | 11/1976 | Hill | 439/610 |
| 4,068,914 | 1/1978 | Mack | 439/610 |
| 4,111,513 | 9/1978 | Thurston | 439/610 |
| 4,169,650 | 10/1979 | Schweizer | 439/610 |
| 4,243,290 | 1/1981 | Williams | 439/610 |
| 4,906,199 | 3/1990 | Twomey et al. | 439/95 |
| 5,052,947 | 10/1991 | Brodie | 439/578 |

*Primary Examiner*—Gary F. Paumen
*Attorney, Agent, or Firm*—Wall and Roehrig

[57] ABSTRACT

A termination bracket for installing a multi-pin connector to a panel or chassis wall permits a table wire braid to be grounded with as short a pigtail is possible, and minimizes the unshielded length of cable at the connector where the braid has been stripped away. The termination bracket can be formed as an aluminum alloy stamping, with a base and one or more comb walls. Slots are provided at the distal edge of the comb wall to receive the grounding pigtails. The comb walls are provided with a solderable surface, such as a copper flash followed by nickel plating.

6 Claims, 3 Drawing Sheets

SHIELD TERMINATOR

BACKGROUND OF THE INVENTION

This invention relates to retainers for cable connectors which mount through an aperture in a metal chassis of electrical or electronic equipment. The invention is more particularly concerned with a combined retainer and grounding terminator for grounding to the chassis the braids or ground conductors of signal conductors or cables within the equipment which are coupled to the associated connector.

Over the years, a variety of techniques have been employed for terminating electrical components where the wire braids or shields are terminated to chassis ground. The purpose here is to avoid stray ground-loop radiation by minimizing inductive reactance between the device or cable ground and chassis ground. This minimizes impedance in the ground path. It is also important to keep the length of the unshielded conductor, near the connector, to a minimum.

When frequencies above about one kilohertz are used, ground path impedance can become a source of problems. These frequencies are common in most electrical equipment that employs radio circuitry or high speed switching circuitry. Thus, it is often necessary to create as nearly as possible a short-circuit ground path to the chassis for alternating currents. This is accomplished either by increasing ground conductor surface area or reducing path length. Grounding of shield wires in cable connectors may be accomplished by use of backshell type hardware, for braid pigtails which connect between braid shield and connector shell, or the pigtail may be inserted into a pin of the connector where it is carried through the mating connector and is grounded internal to the chassis to which the connector mates. The term pigtail is used to mean a wire that provides the electrical connection from a braid or shield to its termination point, but the term is not strictly limited to such wires Pigtails can also be formed of the braid itself where stripped from the cable. An example of backshell type hardware is shown in U.S. Pat. No. 4,111,513 to Thurston et al. Other grounding devices for pigtails and ground wires are shown, e.g., in U.S. Pat. Nos. 4,068,914; 4,906,199; and 3,513,433.

Cable termination devices, such as chassis-mounted connectors, require short terminations internal to the chassis. This is also true for other devices such as panel-mounted switches, fuse holders, and indicator lights. At present, the grounding hardware associated with the device can consist of a grounding stud such as a screw with a nut and washer installed at a location remote from the connector or similar device. Alternatively, backshell hardware can be employed, but that is somewhat expensive and is often difficult to install. Special pin and socket hardware is also available. None of these techniques serve the dual purpose of retaining the connector or other device and also supplying a nearby, convenient, low-impedance path to ground. Backshell hardware, while it can provide a short ground path, is expensive and heavy, and cannot be installed without special training. Also, rework and retrofit is difficult to implement. Special pin and socket hardware reduces path length, but adds space and weight to the finished connector assembly.

OBJECTS AND SUMMARY OF THE INVENTION

It is an object of this invention to provide a bracket for mounting a panel mounted connector or similar device to a wall of a metal chassis, and which provides a convenient, low-impedance ground path for terminating a pigtail from a cable or conductor.

It is another object to provide a terminator bracket that is of simple design and which can be installed without difficulty and without special training.

It is a further object for the terminator bracket to provide a short low-impedance ground path to the chassis with a minimum of intermediate conductor layers.

According to an aspect of the invention, the terminator bracket is formed as a stamping of aluminum alloy with a base plate that fits against the wall of the chassis and one or more comb walls that extend back from edges of the base plate. The base plate has an aperture for the connector device to penetrate and this is positioned in registry with a hole or opening in the chassis. The aperture can have a gap or slot at one side of the plate to permit installation over a pre-wired, pre-assembled connector. In one version, there are captivated threaded nuts at the corners of the base plate for retaining a flange-type connector by means of screws. In another version, a jamb nut mounted device can be retained in the terminator bracket, and the slot or gap is omitted to provide a continuous surround.

Each of the comb walls has a series of soldering slots formed along its proximal edge to receive pigtails from the braid or shield of cables that terminate in the connector. To achieve solderability, the comb wall is provided with a conductive coating of a material that wets with solder. Preferably, where the termination bracket is an aluminum alloy stamping, this coating can be a copper flash followed by a nickel plating. The pigtail is soldered to a slot in the comb wall for a semi-permanent connection. This provides a short, low impedance ground path, but permits removal of the pigtail if rework is required.

The unitary bracket directly connects the pigtail to the chassis wall, without intervening interfaces which would create impedances and could cause stray radiation or interference.

The above and many other objects, features, and advantages of this invention will become apparent from the ensuing description of a preferred embodiment, which should be considered in conjunction with the accompanying Drawing.

DETAILED DESCRIPTION OF THE PREFERRED EMBODIMENT

Figure 1:
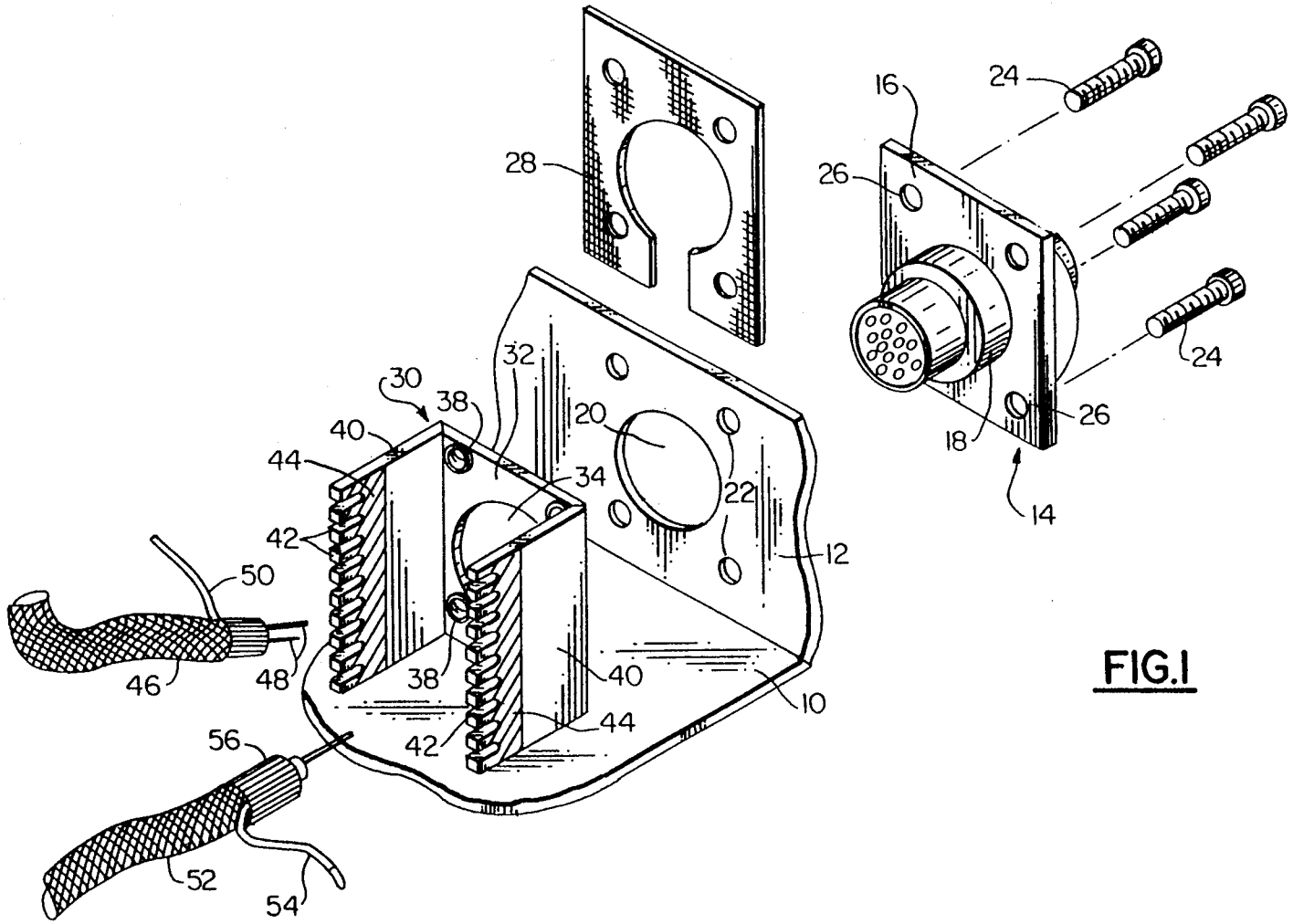
FIG. 1 is an exploded assembly view showing a portion of a chassis, a connector device, and a termination bracket according to one embodiment of the invention.
Figure 4:
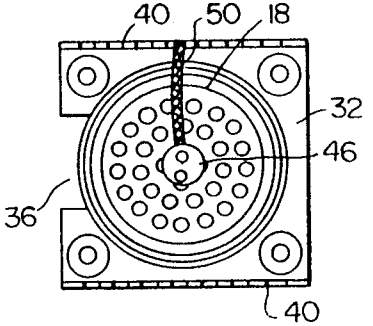
FIGS. 3 and 4 are side and rear elevation taken at 3—3 and 4—4 of FIG. 2.
Figure 7:
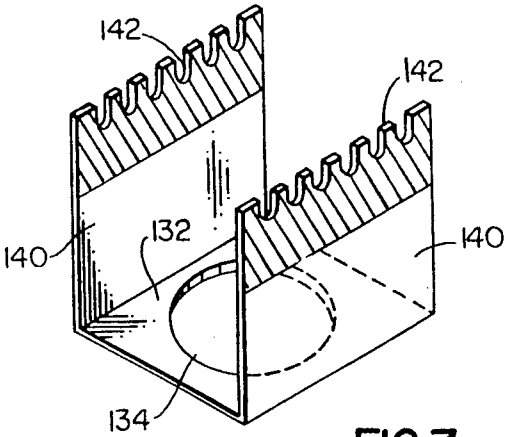
FIG. 7 is an isometric view of the termination bracket according to a second embodiment, for use with a jamb nut-mounted connector device.
Figure 3:
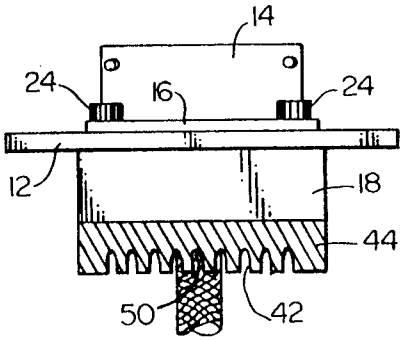
Figure 6:
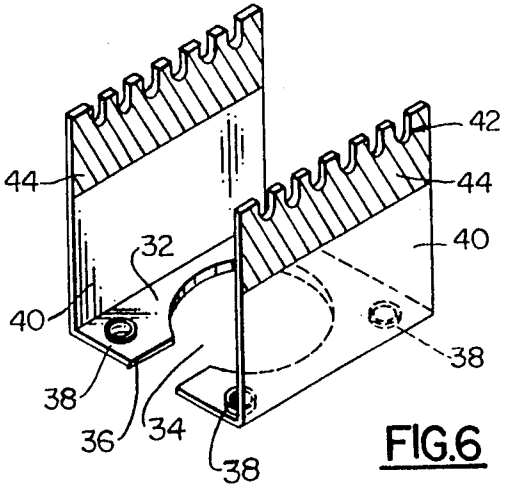
FIG. 6 is an isometric view of the termination bracket of FIG. 1.
Figure 2:
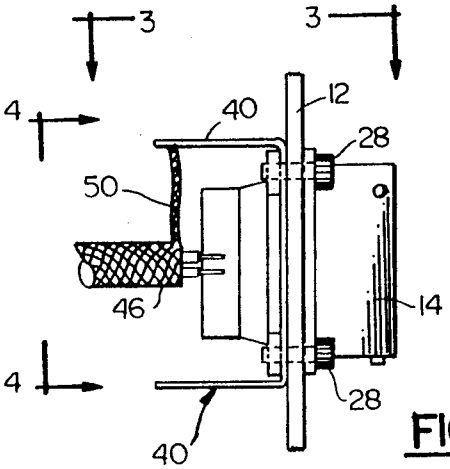
FIG. 2 is a top plan view of the assembly including the termination bracket of FIG. 1.

With reference to the Drawing, and initially to FIGS. 1, 2, 3, 4, 5, and 6, an embodiment of the invention is shown in which a chassis or panel 10 has a wall 12 onto which a flange-type multi-pin connector 14 is mounted. A square flange 16 projects from a generally cylindrical casing 18 of which a proximal side penetrates a circular aperture 20 in the chassis wall 12. Four screw holes 22 provided in the chassis at regular intervals around the aperture 20 receive threaded screws 24 which also pass through holes 26 in the connector flange 16. An optional conductive gasket 28 is also shown.

A termination bracket 30, which secures the connector 14 against the chassis wall 12 is preferably an aluminum alloy stamping. The bracket 30 has a base plate 32 with an aperture 34 that is aligned in registry with the chassis wall aperture 20 and through which the proximal side of the connector casing 18 extends. A slot 36 or gap at one side opens the aperture 34 to the edge of the base plate 32. This slot or gap 36 permits after installation of the termination bracket 30, that is, it permits the multi-pin connector 14 to be preassembled and prewired.

There are four captivated nuts 38 situated at corners of the base plate 32, and these receive the screws 24 that hold down the connector flange 16.

A pair of comb walls 40 are formed unitarily with the base plate 32, and extend proximally, that is, at right angles to the base plate. A plurality of pigtail retaining slots 42 are formed in a row at the proximal edge of each of the comb walls 40. The proximal halves of the comb walls 40 are each provided with a surface coating 44 of a solderable conductive material. In this embodiment, the comb walls 40 are provided with a copper flash, followed by nickel plating. The nickel plate is wettable with solder, so that the pigtails or other metal conductors can be permanently, but removably, attached to respective ones of the slots.

A shielded cable 46 is shown in FIG. 1, with one or more conductors 48 that extend into respective receptacle openings at the proximal end of the connector 14. A grounding pigtail 50 is formed from a stripped portion of the shield or braid of the cable 46, and this pigtail extends to a slot 42 in one of the comb walls 40.

Figure 5:
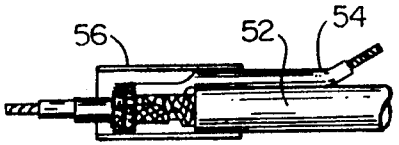
FIG. 5 shows a typical wire braid with pigtail, prepared for installation into the assembly of connector and bracket of the invention.
Figure 9:
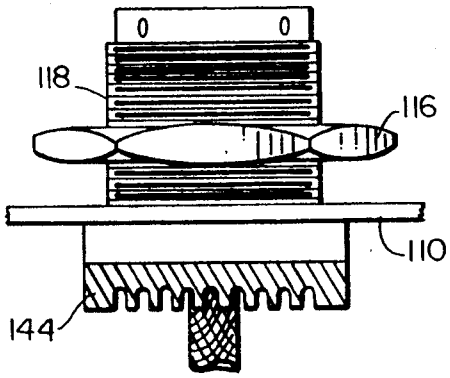
FIGS. 9 and 10 are side and rear elevations taken at 9—9 and 10—10 of FIG. 8.
Figure 10:
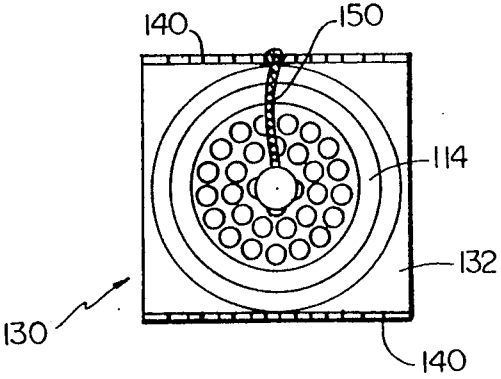
Figure 8:
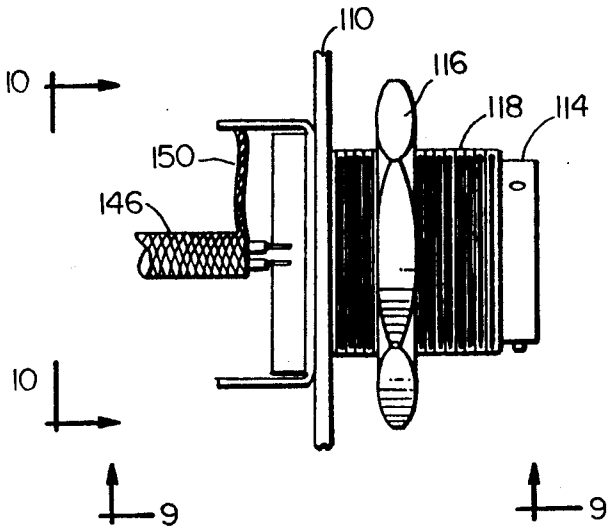
FIG. 8 is a top plan view of an assembly formed of a jamb nut-mounted connector and a bracket according to the embodiment of FIG. 7.

Another cable 52, shown in detail in FIG. 5, has a pigtail 54 formed of a separate wire jumper, which is soldered or otherwise attached at one end onto the cable braid. A non-conductive sleeve 56, for example shrink tubing, provides isolation of the exposed portion of the braid.

As mentioned previously, optional gasket 28 can be employed, for example between the terminator bracket base plate 32 and the chassis wall 12, to ensure electrical contact between those two surfaces. However, this gasket will only rarely be required.

A second embodiment of the invention is shown in FIGS. 7, 8, 9, and 10. In the second embodiment, the same or similar elements are identified with the same reference numbers as previously used but raised by 100. A detailed description of the elements common to both embodiments is omitted.

In this second embodiment, a termination bracket 130 has an opening 134 that is provided without the gap or slot, thus providing a complete surround between the chassis 110 and the proximal end of an associated connector 114. In this case, the multi-pin connector is a jamb-nut type connector 114, which is secured by means of a nut 116 which screws onto a threaded distal end 118 of the connector casing, and tightens against an exterior surface of the chassis wall 110. This embodiment omits the captivated nuts that are found in the bracket 30 of the previous embodiment. However, as with the first embodiment, a grounding pigtail 150 of the braid from the grounded braid of a cable 146 is secured into a slot at the distal edge of one of the two comb walls 140. The comb walls are also provided with a copper flash followed by a nickel plating to provide a solderable surface 144.

In either of these two embodiments, the grounding pigtail 50, 54, 150 follows a short path to chassis ground through the comb wall 40, which, because of its geometry, has as low an inductance as possible. On the other hand, the geometry of the terminator bracket 30 or 130 permits after-installation of additional conductors or cables and further permits unobstructed and simple grounding of their conductive braids or shields, through a suitable pigtail, to chassis ground. A low impedance circuit termination point is provided for circuit components at the point of entry to the associated enclosure, thereby simplifying control of interference or stray signals.

In addition to the multi-pin connectors as shown, other devices, such as switches, either rotary or toggle, lamp sockets, fuse holders, or multi-functional devices can be installed employing the termination bracket of this invention. Grounding to the chassis through the termination bracket provides as low impedance as possible because the number of interfaces between the pigtail and the chassis is kept to a minimum. Soldering of pigtails to respective slots in the terminator is simplified, as is removal of the pigtails, thereby facilitating both installation and reconfiguration.

While the present invention has been described with respect to certain preferred embodiments, it should be understood that the invention is not limited to those precise embodiments. Rather many modifications and variations would present themselves to those of skill in the art without departing from the scope and spirit of this invention, as defined in the appended claims.

What is claimed is:

1. A chassis ground terminator for a multi-pin panel-mounted connector device or similar device of the type mounted through an aperture in a conductive wall of a chassis, and wherein the device has a proximal end face positioned in the chassis with means to receive at least one wire conductor which further includes a grounding pigtail; said terminator comprising a base plate disposed against said chassis wall having an aperture through which a portion of said device extends, and at least one comb wall formed integrally with said base plate and extending proximally therefrom, said comb wall including at least one slot at a proximal edge thereof and having a surface suitable to wet with solder so that the grounding pigtail of said wire conductor can be soldered into said at least one slot.

2. The chassis ground terminator of claim 1 wherein the terminator is formed of a stamping of an aluminum alloy and said comb wall includes a coating of a solderable conductive material.

3. The chassis ground terminator of claim 2 wherein said coating includes copper flash on said aluminum alloy plated with nickel.

4. The chassis ground terminator of claim 1 wherein said device comprises a pair of comb walls formed on opposite edges of said base plate, and each having a plurality of slots formed along a proximal edge thereof.

5. The chassis ground terminator of claim 1 wherein said aperture in the base plate has a gap extending to one edge of the base plate, of sufficient width to permit after-installation of the terminator over a pre-wired, preassembled connector device.

6. The chassis ground terminator of claim 1 further comprising a plurality of captivated threaded nuts affixed onto said base plate to permit attachment by means of threaded fasteners to a flange of the associated device.

* * * * *